United States Patent [19]

Cain et al.

[11] 4,417,854

[45] Nov. 29, 1983

[54] COMPLIANT INTERFACE FOR CERAMIC TURBINE BLADES

[75] Inventors: Edwin F. C. Cain, Canoga Park; William T. McFarlen, Thousand Oaks, both of Calif.

[73] Assignee: Rockwell International Corporation, El Segundo, Calif.

[21] Appl. No.: 369,723

[22] Filed: Apr. 19, 1982

Related U.S. Application Data

[63] Continuation-in-part of Ser. No. 132,575, Mar. 21, 1980, abandoned.

[51] Int. Cl.[3] ..... F01D 5/28

[52] U.S. Cl. ..... 416/241 B; 416/219 R; 416/221

[58] Field of Search ..... 416/213 R, 219 R, 221 R, 416/224, 241 B

[56] References Cited

U.S. PATENT DOCUMENTS

| | | | |
|---|---|---|---|
| 1,150,436 | 8/1915 | Lang | 416/224 |
| 3,897,171 | 7/1975 | Stahl | 416/213 X |
| 3,922,109 | 11/1975 | Hagen | 416/213 R |
| 3,932,227 | 1/1976 | Rothenberg | 204/16 |
| 4,142,836 | 3/1979 | Glenn | 416/219 R X |
| 4,207,029 | 6/1980 | Ivanko | 416/220 R X |
| 4,323,394 | 4/1982 | Hoffmüller et al. | 416/213 R X |

FOREIGN PATENT DOCUMENTS

| | | | |
|---|---|---|---|
| 2250563 | 5/1973 | Fed. Rep. of Germany | 416/219 |
| 664986 | 1/1952 | United Kingdom | 416/219 |

*Primary Examiner*—Philip R. Coe
*Assistant Examiner*—Thomas W. Epting
*Attorney, Agent, or Firm*—H. Fredrick Hamann; Harry B. Field

[57] ABSTRACT

The present invention provides a ceramic turbine blade having a ceramic root flange and a metallic compliant layer which is electroformed to the ceramic root flange and then machine-formed to the geometry required for attachment to the turbine disk. Because of its intimate bond to the surface of the ceramic root flange and because of its compliant nature, the metallic compliant layer serves to uniformly distribute stresses induced by the attachment of the blade to the turbine disk. The present invention also envisions the attachment and use of a fir tree root section to an otherwise complete ceramic blade without risk of stress fracture or modification of the turbine disk.

16 Claims, 4 Drawing Figures

COMPLIANT INTERFACE FOR CERAMIC TURBINE BLADES

This application is a continuation-in-part of the application Method of Joining Metallic Components to Ceramics, Ser. No. 132,575 filed Mar. 21, 1980 by Edwin F. C. Cain and William T. McFarlen and abandoned on June 3, 1982.

BACKGROUND OF THE INVENTION

1. Field of the Invention

The present invention relates to ceramic turbine disk assemblies and more particularly to the use of an electroformed compliant layer at the interface of a ceramic turbine blade and a turbine disk.

2. Description of the Prior Art

In a number of government-funded programs $Si_3N_4$ and SiC hardware are being successfully tested for use in the hot gas path of gas turbine engines. Success of these nonoxide components can be attributed to improved formulations and methods for fabricating shapes with high strength and good resistance to oxidation. Design methodology for brittle materials has also advanced towards the goal of improving reliability of ceramic components in turbine engines.

However, the design and fabrication of ceramic-to-metal and ceramic-to-ceramic joints remains a problem. Such joints are prone to failure because ceramics do not yield locally, as do metals, and critical stresses can readily develop in the ceramic assembly at the point of contact.

An example is a ceramic turbine blade with a metal disc joint. The conventional fir tree root configuration used on metal blades cannot be normally used for ceramics because ceramics do not yield at contact points to spread the load over a larger surface. On the contrary, critical stresses are developed in the ceramic and failure of the ceramic results.

Two methods have been pursued for spreading the contact zones between ceramic and metal surfaces over larger areas. One is to forge the metal disc around the ceramic blade roots. Disadvantages include complexity of the fabrication process, limited alloy selection, and possible damage to the blade during processing. The more popular method for enlarging the contact loading area is to insert a compliant layer of ductile material between the ceramic root and the surface of the slot in the metal disc. Compliant materials are selected to yield sufficiently at service temperature to increase contact area but to not yield so much that the ceramic root touches the metal disc. Among their disadvantages, however, is that they do not assure intimate and continuous surface contact especially under loading such that their ability to evenly distribute local stress about a ceramic blade is impaired. Compliant layers include metal foils of such alloys as L605 and Haynes 188, and certain glasses.

OBJECTS OF THE INVENTION

Therefore, it is an object of the present invention to provide a ceramic turbine blade which can be mounted directly to a turbine disk without risk of fracture to the ceramic blade.

Another object of the present invention is to provide a turbine disk assembly having ceramic blades which can withstand the stresses which arise from contact with the turbine disk.

Another object of the present invention is to provide a ceramic blade suitable for use with an existing turbine disk having fir tree shaped footings.

Yet another object of the present invention is to provide a ceramic-to-metal joint which does not damage the ceramic surface.

Another object of the present invention is to provide a ceramic turbine stage assembly.

Another object of the present invention is to provide a metal which is in intimate contact with 100% of the treated ceramic surface.

Another object of the present invention is to provide a ceramic-to-metal joint wherein the mismatched thermal properties of the materials are not necessarily a problem.

A further object of the present invention is to permit conventional brazing of a metal layer on the ceramic component to another metal structure.

Yet a further object of the present invention is to provide a practical means for making a ceramic-to-metal joint.

Another object of the present invention is to provide a ceramic-to-metal joint which is cost effective.

SUMMARY OF THE INVENTION

The present invention achieves these and other objectives by providing a ceramic turbine blade having a ceramic root flange and a metallic compliant layer which is electroformed to the ceramic root flange and then machine-formed to the geometry required for attachment to the turbine disk. Because of its intimate bond to the surface of the ceramic root flange and because of its compliant nature, the metallic compliant layer serves to uniformly distribute stresses induced by the attachment of the blade to the turbine disk. The present invention also envisions the attachment and use of a fir tree root section to an otherwise complete ceramic blade without risk of fracture in the blade or modification of the turbine disk.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
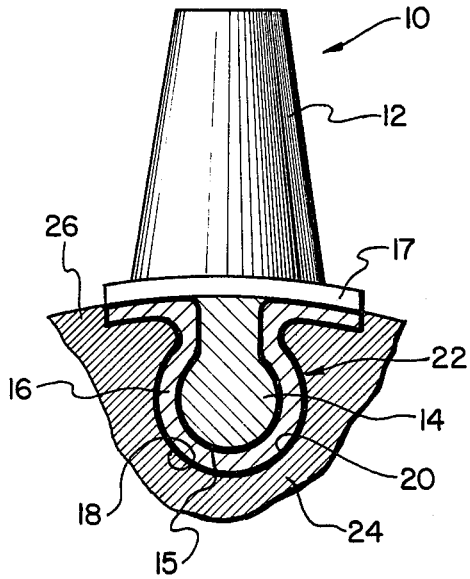
FIG. 1 is a schematic of a ceramic-to-metal joint for a turbine blade.

Referring now to FIG. 1 there is provided a ceramic turbine blade generally designated at 10 comprising an integrally formed, ceramic blade body 12 and root flange 14. Electroformed onto root flange 14 is a metallic compliant layer 16 whose exterior surface 18 is in substantial surface contact with interior surfaces 20 of a slotted footing 22 of turbine disk 24. It is to be understood that metallic compliant layer 16 extends also to provide surface contact where base 17 of ceramic turbine blade 10 comes into proximity with peripheral surface 26 of turbine disk 24.

Initially the surface of the nonconductive ceramic is made conductive by coating an area of the ceramic material with a conductive layer 15 with any appropriate means such as chemical vapor deposition, as descrived in *Vapor Deposition,* Powell, C. F., Oxlye, J. H., and Blocher, J. M., editors, John Wiley and Sons, Inc., New York 1966, included herein by reference; the chemical reduction of a chemical species, as described *Metal Finishing Guidebook,* Metals and Plastics Publications, Inc., Westwood, N. J., USA 1967, p. 483, included herein by reference; or by plasma spray, described in *Plasma Jet Technology,* Dennis, P. R. et al, editors, National Aeronautics and Space Administration, Washington, D.C., USA October 1965 NASA SP 5033; and *Flame Spray Handbook Vol. III,* Plasma Flame Processes, Ingham, H. S. and Shepard, A. P., METCO INC., Westbury, L. I. N.Y. 1965; included herein by reference. These processes are used to generate a layer of any conductive material such as copper, nickel, platinum, silver, gold, aluminum, or any of a plurality of alloys such as nickel cobalt. Once the conductive layer has been prepared any conductive metal, whether element or alloy, can then be electrodeposited over the now conductive area of the ceramic to form metallic compliant layer 16. Once the conductive area of the ceramic is prepared, the process for electrodepositing these kinds of materials is handled in accordance with known electroforming technology.

Although any conductive metal can be readily electrodeposited over the conductive area of the ceramic, the preferred metals include platinum, gold, silver, copper, nickel, aluminum, or nickel cobalt, while the most preferred, from an economic and physical properties standpoint, are nickel nickel-cobalt tungsten and nickel cobalt.

Subsequent to electrodeposition, metallic compliant layer 16 is machined to the geometry required for engagement with an appropriate foundation such as footing 22 of turbine disk 24. Because the metallic compliant layer 16 is in intimate bonded contact with the ceramic material of footing 14 of turbine blade 10, point stresses induced at the interface between metallic compliant layer 16 and footing 1 are distributed in a uniform manner about ceramic root flange 14 by the yielding of metallic compliant layer 16 on a specific localized basis.

Figure 2:
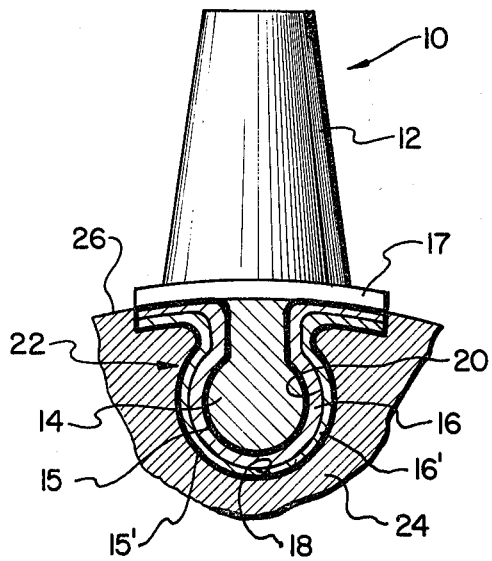
FIG. 2 is a schematic of a ceramic-to-ceramic joint for a turbine blade.

It should be noted that the process described herein is not only advantageous for use in ceramic-to-metal joints, but also can be used for ceramic-to-ceramic joints as can be appreciated by reference to FIG. 2 wherein is shown the joinder of ceramic turbine blade 10 and a turbine disk 24 made of ceramic material. This can be accomplished by forming a conductive layer 15 on the areas of contact between the two components, viz, on root flange 14 of turbine blade 10 and on interior surfaces 20 of footing 22. Then, metallic compliant layers 16 are electrodeposited on the root flange 14 and on interior surfaces 20. The metal compliant layers 16 are then machined to the required geometry and then mechanically assembled. Upon assembly, the joined components may be brazed in accordance with standard technique if desired. Thusly, the electrodeposited metal interface forms a perfect fit even at localized points on the surface on which a fit cannot be obtained by conventional means.

Figure 3:
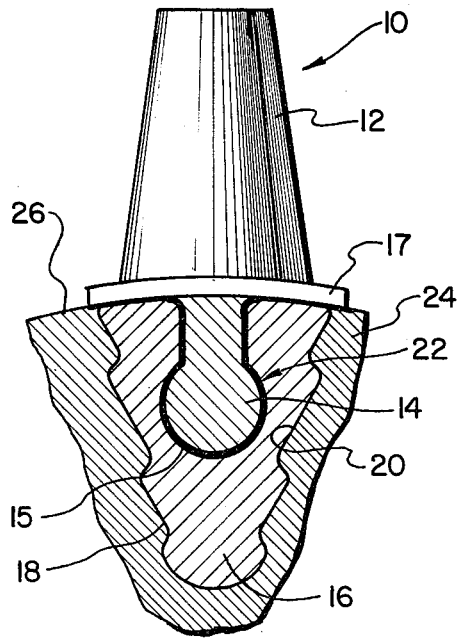
FIG. 3 is a schematic of a ceramic blade having fir tree root section electroformed directly to the ceramic root flange of the blade.
Figure 4:
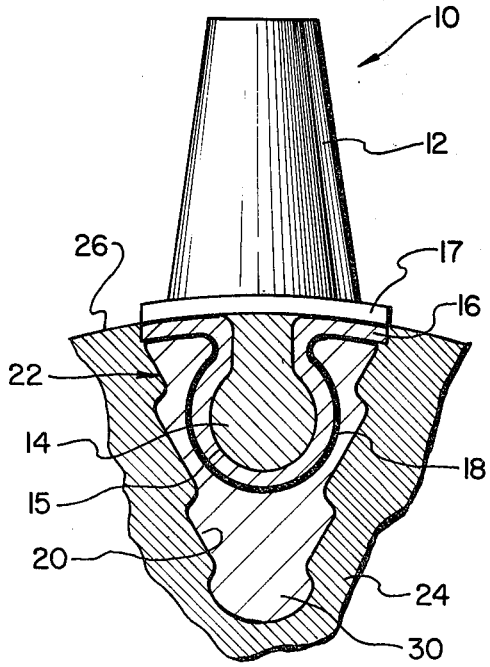
FIG. 4 is a schematic of a ceramic blade having a metallic fir tree root section brazed to an electroformed metallic layer on the ceramic root flange of blade.

Referring now to FIG. 3, there is shown an alternative embodiment of the present invention which allows for the joinder of a ceramic turbine blade 10 to a turbine disk 24 having footings 22 whose interior surfaces 20 are suitable for receiving fir tree type root flanges, the alternative embodiment comprising a ceramic root flange 14, conductive layer 15 and metallic compliant layer 16 of similar construction as explained before except that metallic compliant layer 16 is built up sufficiently and then machined to form a fir tree. Alternatively and as can be best appreciated by reference to FIG. 4, a separate fir tree shaped root element 30 can be fabricated separately from the blade and be attached to a metallic compliant layer 16 of a ceramic turbine blade 10 constructed according to the preferred embodiment as shown in FIG. 1. Upon their joinder, and brazing if desired, the resultant assembly is then inserted in the fir tree shaped footing 22 of turbine disk 24.

Obviously, many modifications and variations of the present invention are possible in light of the above teachings. It is, therefore, to be understood that, within the scope of the appended claims, the invention may be practiced otherwise than as specifically described.

What is claimed and desired to be secured by Letters Patent of the United States is:

1. A ceramic turbine blade suitable for attachment to a turbine disk having a peripheral surface and a series of footings in said peripheral surface, each of said footings having interior surfaces for receiving a turbine blade, said ceramic blade comprising:

a ceramic body comprising a blade body and a root flange, a first layer of conductive metal deposited onto said root flange by chemical deposition, at least one layer of compliant metal electroformed onto said first layer, said compliant layer having an exterior surface engageably conforming to said interior surfaces of one of said footings.

2. A ceramic turbine blade as claimed in claim 1 wherein said compliant layer forms a fir tree root.

3. A ceramic blade as claimed in claim 1 wherein said exterior surface of said compliant layer is brazed to said turbine disk.

4. A ceramic turbine blade suitable for attachment to a turbine disk having a peripheral surface and a series of footings, each of said footings having interior surfaces for receiving turbine blades, said ceramic turbine blade comprising:

a ceramic body comprising a blade body and a root flange, a first layer of conductive metal deposited onto said root flange by chemical deposition, at least one layer of compliant metal electroformed onto said root flange of said ceramic body and having exterior surfaces, a root element affixed to said exterior surfaces of said compliant layer of said root flange, said root element having surfaces engageable with said interior surfaces of said footings of said turbine disk.

5. A ceramic turbine blade as claimed in claim 4 wherein said exterior surfaces of said root element are of fir tree shape.

6. A ceramic turbine blade as claimed in claim 1 or 4 wherein said compliant layer comprising nickel.

7. A ceramic turbine blade as claimed in claim 1 or 4 wherein said compliant layer comprising nickel-cobalt alloy.

8. A ceramic turbine blade as claimed in claim 1 or 4 wherein said compliant layer comprises nickel-cobalt-tungsten.

9. A method for affixing ceramic turbine blades to a turbine disk having a peripheral surface and a series of footings in said peripheral surface, each of said footings having interior surfaces for receiving a turbine blade, said method comprising the steps of:

providing a ceramic root flange to said ceramic turbine blade, depositing onto said root flange an initial layer of conductive metal by chemical deposition about a substantial entirety of said root flange, electroforming at least one layer of compliant metal upon said initial layer, machining said layer of compliant metal to form exterior surfaces which engageably conform to the substantial entirety of said footings of said turbine disk, engaging said exterior surfaces of said layer of compliant metal of said ceramic turbine blade with said interior surfaces of one of said footings.

10. A method as claimed in claim 9 wherein said method also includes the step of brazing said layer of compliant metal of said ceramic turbine blade to said turbine disk.

11. A method as claimed in claim 9 wherein said turbine disk is ceramic and said method further comprises the steps of depositing onto said interior surfaces of said footings of said turbine disk an initial layer of conductive metal by chemical deposition and electroforming at least one layer of compliant metal upon said initial layer on said footings.

12. A method for affixing a ceramic turbine blade to a turbine disk having a periperal surface and a series of footings in said peripheral surface, each said footings having interior surfaces for receiving a turbine blade, said method comprising the steps of:

providing a ceramic root flange to said ceramic turbine blade, depositing onto said root flange an initial layer of conductive metal by chemical deposition, electroforming at least one layer of compliant metal upon said initial layer, fitting a root element over said layer of compliant metal, said root element having exterior surfaces engageably conforming with said interior surfaces of said footings of said turbine disk, engaging said exterior surfaces of said root element of said ceramic turbine blade with said interior surfaces of one of said footings of said turbine disk.

13. A method as claimed in claim 12 wherein said method comprises also the step of brazing said root element to said layer of compliant metal.

14. A method as claimed in claim 12 or 13 wherein said exterior surfaces of said root element are of fir tree shape.

15. A ceramic turbine assembly comprising:

a turbine disk having a peripheral surface and a series of footings in said peripheral surfaces, each of said footings having interior surfaces for receiving a turbine blade, a plurality of ceramic turbine blades, each comprising a ceramic body including a ceramic root, a first layer of conductive metal deposited onto said ceramic root by chemical deposition, and at least one layer of compliant metal electroformed onto said first layer, said compliant layer having exterior surfaces providing secure engagement with said interior surfaces of said footings of said turbine disk.

16. A ceramic turbine assembly as claimed in claim 15 wherein said turbine disk is ceramic and further comprises an initial layer of conductive metal deposited onto each of said footings by chemical deposition and a layer of compliant metal electroformed onto each of said initial layers, said compliant layers having surfaces for defining said interior surfaces for receiving a turbine blade.

* * * * *